US009556859B2

(12) United States Patent
Gaertner

(10) Patent No.: US 9,556,859 B2
(45) Date of Patent: Jan. 31, 2017

(54) PISTON PUMP FOR DELIVERING FLUIDS, AND CORRESPONDING ASSEMBLY PROCESS FOR A PISTON PUMP

(75) Inventor: Oliver Gaertner, Abstatt (DE)

(73) Assignee: Robert Bosch GmbH, Stuttgart (DE)

( * ) Notice: Subject to any disclaimer, the term of this patent is extended or adjusted under 35 U.S.C. 154(b) by 325 days.

(21) Appl. No.: 14/235,348

(22) PCT Filed: May 29, 2012

(86) PCT No.: PCT/EP2012/060043

§ 371 (c)(1),
(2), (4) Date: Jan. 27, 2014

(87) PCT Pub. No.: WO2013/013865

PCT Pub. Date: Jan. 31, 2013

(65) Prior Publication Data

US 2014/0147314 A1 May 29, 2014

(30) Foreign Application Priority Data

Jul. 27, 2011 (DE) ..... 10 2011 079 876

(51) Int. Cl.
*F04B 11/00* (2006.01)
*F04B 13/00* (2006.01)
*F04B 1/04* (2006.01)

(52) U.S. Cl.
CPC ..... *F04B 13/00* (2013.01); *F04B 1/0404* (2013.01); *F04B 11/0033* (2013.01); *F04B 11/0091* (2013.01); *Y10T 29/49236* (2015.01)

(58) Field of Classification Search
CPC . F04B 1/0404; F04B 11/0033; F04B 11/0091; F04B 53/10; F04B 53/102; F04B 53/1022; F04B 49/225; F04B 49/24
See application file for complete search history.

(56) References Cited

U.S. PATENT DOCUMENTS 5,199,860 A * 4/1993 Stegmaier ..... B60T 8/4031 137/533.17
5,232,273 A * 8/1993 Eckstein ..... B60T 8/4031 137/539

(Continued)

FOREIGN PATENT DOCUMENTS

DE 10 2006 027 555 A1 12/2007
DE 102006027555 A1 * 12/2007 ..... B60T 8/4031

(Continued)

OTHER PUBLICATIONS

International Search Report corresponding to PCT Application No. PCT/EP2012/060043, mailed Jul. 30, 2012 (German and English language document) (7 pages).

*Primary Examiner* — Devon Kramer
*Assistant Examiner* — Joseph Herrmann
(74) *Attorney, Agent, or Firm* — Maginot, Moore & Beck LLP

(57) ABSTRACT

A piston pump for delivering fluids includes a cylinder, a piston that is movably mounted in the cylinder, and a pressure chamber that is arranged between an inlet valve and an outlet valve and that is closed off by a cover. The piston pump further includes a throttle element that is disposed in the fluid flow downstream of the outlet valve and that is configured to throttle the fluid flow. The throttle element is in the form of a resiliently elastic disk that is inserted into the cover. The cover further includes a mechanism configured to pre-center the throttle element.

8 Claims, 5 Drawing Sheets

(56) References Cited

U.S. PATENT DOCUMENTS

| | | | | | |
|---|---|---|---|---|---|
| 5,406,976 | A * | 4/1995 | Bekki | F16H 61/0009 | 137/513.3 |
| 6,764,286 | B2 * | 7/2004 | Hunnicutt | B60T 8/4031 | 137/859 |
| 6,837,694 | B2 * | 1/2005 | Furuya | B60T 8/4031 | 417/273 |
| 7,278,835 | B2 * | 10/2007 | Schmitt | B60T 8/4031 | 138/26 |
| 2007/0137304 | A1 | 6/2007 | Rutherford et al. | | |
| 2008/0317618 | A1 * | 12/2008 | Kim | B60T 8/4031 | 417/540 |
| 2011/0099995 | A1 * | 5/2011 | Schuller | B60T 8/4031 | 60/591 |

FOREIGN PATENT DOCUMENTS

| | | | | |
|---|---|---|---|---|
| DE | 10 2008 002 740 | A1 | 12/2009 | |
| DE | WO 2009156215 | A1 * | 12/2009 | B60T 8/4031 |
| JP | 2001-225742 | A | 8/2001 | |
| JP | 2004-529284 | A | 9/2004 | |
| JP | 2004-532957 | A | 10/2004 | |
| JP | 2005-30365 | A | 2/2005 | |
| WO | 02/072398 | A1 | 9/2002 | |
| WO | 03/004872 | A1 | 1/2003 | |
| WO | 2012/028362 | A2 | 3/2012 | |
| WO | 2012/028364 | A1 | 3/2012 | |

* cited by examiner

PISTON PUMP FOR DELIVERING FLUIDS, AND CORRESPONDING ASSEMBLY PROCESS FOR A PISTON PUMP

This application is a 35 U.S.C. §371 National Stage Application of PCT/EP2012/060043, filed on May 29, 2012, which claims the benefit of priority to Serial No. DE 10 2011 079 876.5, filed on Jul. 27, 2011 in Germany, the disclosures of which are incorporated herein by reference in their entirety.

BACKGROUND

The disclosure starts from a piston pump for delivering fluids. In addition, the present disclosure relates to an assembly process for such a piston pump.

Piston pumps are known from the prior art in various embodiments. For example, radial piston pumps having a plurality of pump elements for delivering pressure media, wherein at least one piston is movable reciprocatingly by means of an eccentric, are frequently used in vehicle brake systems. These so-called pump elements typically consist of a piston, a piston running surface often in the form of a cylinder, inlet and outlet valves and sealing elements. The valves serve to control the fluid during the pumping movement of the piston. In this case the inlet valve serves to prevent the fluid from flowing back into the suction chamber during the compression phase. The outlet valve prevents the fluid from flowing back from the pressure side into the pump interior and is typically housed in the cover of the pump. In order to optimize noise and pulsation, at least one throttle arrangement for throttling the fluid flow is provided downstream of the outlet valve.

The patent application DE 10 2008 002 740 A1 describes, for example, a piston pump for regulating brake pressure in a hydraulic vehicle brake system. The piston pump described comprises a pump housing, a receiving bore for the piston pump arranged in the pump housing and a valve cover closing the receiving pump to the outside, in which cover an outlet valve and first and second channel sections of a discharge channel are accommodated. The discharge geometry influences the noise behavior of the piston pump and is therefore usually implemented with a suitable narrowing of the discharge channel, which then provides a throttling effect.

The patent application DE 10 2006 027 555 A1 describes, for example, a piston pump with reduced noise generation. The piston pump for delivering fluids which is described comprises a piston, a cylinder element, and a pressure chamber which is arranged between an inlet valve and an outlet valve and is closed by a cover; the outlet valve comprises a closing body in the form of a ball, a pretensioning device in the form of a helical spring acting on the closing body; the pump further comprises a base element for supporting the pretensioning device and a disk element, a sealing seat of the outlet valve being arranged in the disk element. The use of the disk element is intended to ensure that component tolerances of various components of the piston pump do not negatively affect the outlet valve.

SUMMARY

The sensor unit according to the disclosure for a vehicle has, in contrast, the advantage that it makes possible a cost-neutral pre-centering of a throttle element configured as a resilient disk in a cover without impeding the oscillating movement of the throttle element in operation.

The core of the disclosure is a cost-neutral centering of the throttle element configured as a resilient disk. The throttle element is inserted in the cover of the piston pump during assembly. The pump cylinder is then pressed onto the cover. Although centering of the throttle element is provided in the pump cylinder, deformation of an insufficiently pre-centered throttle element can occur as a result of rapid assembly. It is therefore appropriate to pre-center the throttle element in the cover prior to assembly of the pump cylinder. However, this pre-centering must not restrict the movement of the throttle element since a blocked throttle element impedes the operation of the piston pump and can lead to system failure through overloading of a drive.

Embodiments of the present disclosure make available a piston pump for delivering fluids comprising a cylinder, a piston mounted movably in the cylinder and a pressure chamber which is arranged between an inlet valve and an outlet valve and is closed by a cover, a throttle element for throttling the fluid flow being provided in the fluid flow downstream of the outlet valve. According to the disclosure the throttle element is configured as a resilient disk which is inserted in the cover, means for pre-centering the throttle element being present in the cover.

In a process according to the disclosure for assembling a piston pump comprising a cylinder, a piston mounted movably in the cylinder and a pressure chamber which is arranged between an inlet valve and an outlet valve and is closed by a cover, a throttle element for throttling the fluid flow being provided in the fluid flow downstream of the outlet valve, the throttle element is configured as a resilient disk and is inserted in the cover. In this case centering means arranged in the cover effect a pre-centering of the throttle element in the cover, and the cylinder element is pressed into the cover after the throttle element has been inserted and pre-centered.

Advantageous improvements of the piston pump specified in the disclosure are made possible by the measures and developments enumerated in the dependent claims.

It is especially advantageous that at least two pressing lugs against which the cylinder is pressed together with the cover are formed on the cover, at least one recess formed between two pressing lugs acting as a discharge channel for the fluid flow. The centering means include, for example, at least one chamfer which is arranged on such a pressing lug rearwardly in the pressing-in direction. In this region obstructions resulting from the pressing-in of the cylinder advantageously cannot occur. In addition, the chamfers can be implemented in a cost-neutral manner in the cover which is produced, for example, as a cold-formed part.

In an advantageous configuration of the piston pump according to the disclosure, the individual chamfers are each arranged at an acute angle which preferably is greater than 60°. Because of the acute angle it can advantageously be ensured that the throttle element does not jam against the chamfer or the centering means in operation.

In a further advantageous configuration of the piston pump according to the disclosure, an annular channel, which is covered by the throttle element and is filled with fluid when the outlet valve is open, is formed in the cover, which fluid flows out via the throttle element into at least one discharge channel.

In a further advantageous configuration of the piston pump according to the disclosure, the throttle element, in the form of a resilient disk, is arranged between the cylinder and the cover and variably adjusts the flow cross section in the at least one discharge channel in dependence on the pressure difference between its upper side and underside. By means of this variable throttle cross section a reduction of pulsation in a fluid system and a robust design can be achieved with simple and low-cost components which can be assembled in a reliable process. The throttle element in the form of a resilient disk may be arranged between the cover and the cylinder with a defined pretension, so that an opening differential pressure is predefined. The pressure difference lifts the throttle element, configured as a resilient disk, from the side with the higher pressure, so that the throttle element configured as a resilient disk performs a deformation movement along the axis of symmetry and enlarges the flow cross section.

In a further advantageous configuration of the piston pump according to the disclosure, the deformation movement of the throttle element configured as a resilient disk may be limited by a corresponding shaping of an end face of the cylinder. The service life of the throttle element can thereby advantageously be increased. In the region of the stop, fluidic damping of the end position can further optimize opening and noise behavior.

It is especially advantageous that the throttle element configured as a resilient disk has a first opening through which fluid can flow, in which case, in a raised position of the throttle element configured as a resilient disk, fluid flows through the first opening of the throttle element configured as a resilient disk and/or flows around the throttle element configured as a resilient disk.

In a further configuration of the piston pump according to the disclosure, a second opening which has a defined constant flow cross section and is opened independently of the differential pressure is present. The second opening may be implemented, for example, as a bore formed in the throttle element configured as a resilient disk, and/or as a depression formed in support surfaces, and/or as an annular gap. The second opening in the throttle element configured as a resilient disk acts as an additional static throttle and makes possible a simple and cost-effective implementation of a dynamic throttle with a static component. The advantage of such a design is that the positive functions of a dynamic throttle can be combined and integrated with a static throttle in a very cost-effective and easily assembled manner. The design involves an additional component which may be implemented, for example, as a stamping or an etched component. If a particular pressure difference is attained, the throttle element configured as a resilient disk bends and the dynamic throttle opens, so that a large additional quantity of fluid can flow out. Below the predefined pressure difference, a smaller quantity of fluid flows out via the static throttle, that is, through the second opening.

BRIEF DESCRIPTION OF THE DRAWINGS

An exemplary embodiment of the disclosure is represented in the drawings and is explained more detail in the following description. In the drawings the same reference symbols denote components or elements which perform the same or analogous functions.

DETAILED DESCRIPTION

Figure 1:
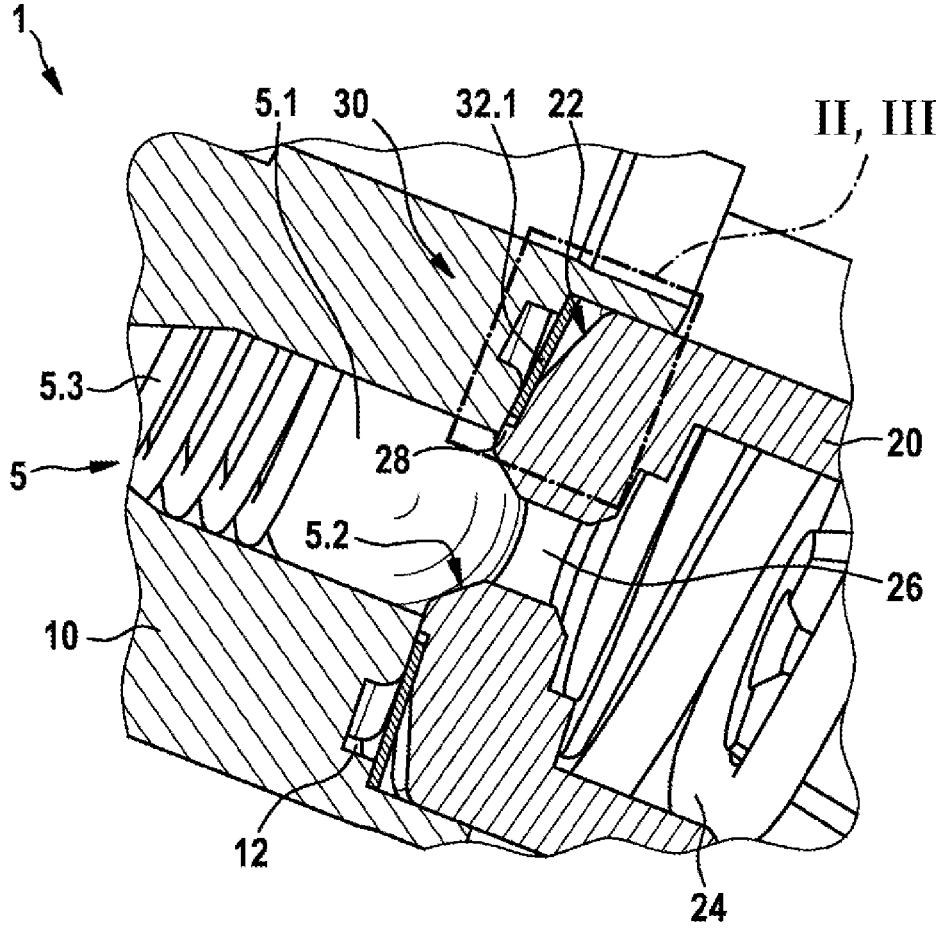
FIG. 1 shows a perspective sectional representation of a rear portion of an exemplary embodiment of a piston pump for conveying fluids according to the disclosure.

In the integration of a dynamic throttle in a piston pump used, for example, in an antilock system (ABS) and/or for an electronic stability program in the vehicle, the centering of the throttle element may be effected, for example, by means of a small chamfer on the cylinder. Rough centering using the external diameter of the throttle element on the cover is possible to only a limited extent, since deformation of the throttle element can occur as a result of the high pressing-in speeds of the cylinder into the cover, if the throttle element is not correctly centered. Furthermore, it must be prevented that the throttle element abuts on one side, causing possible jamming of the throttle element. A jammed throttle element will prevent the buckling function of the dynamic throttle element and the high through-flow rate. This can lead, inter alia, to a complete system failure since the drive is overloaded.

As can be seen from FIGS. 1 to 9, the illustrated exemplary embodiment of a piston pump 1 for delivering fluids according to the disclosure in a vehicle brake system comprises a piston (not shown), a cylinder 20 and a pressure chamber 24 arranged between an inlet valve (not shown) and an outlet valve 5, which pressure chamber 24 is closed by a cover 10, a throttle element 30 for throttling the fluid flow 3 being provided in a fluid flow 3 downstream of the outlet valve 5.

As is further apparent from FIG. 1, the outlet valve 5 comprises a closing body 5.1 in the form of a ball, an outlet valve seat 5.2 and a return spring 5.3, and establishes the fluid flow 3 between an outlet orifice of the pressure chamber 24 and at least one discharge channel 7 of the piston pump 1. The throttle element 30 is configured as a resilient disk and is clamped between the cover 10 and the cylinder. In the exemplary embodiment illustrated the throttle element 30 configured as a resilient disk has a first opening 34 which is adapted to the dimension of the closing body 5.1.

As is further apparent from FIGS. 1 to 5, the throttle element 30 configured as a resilient disk is clamped between a first support surface on the cylinder 20 and a second and third support surface arranged in the cover 10. In order to set the pretension of the throttle element 30 configured as a resilient disk, an offset dv1 is present between the second support surface arranged in the cover 10, against which the outer edge of the throttle element 30 configured as a resilient disk bears, and the third support surface arranged in the cover 10, against which the inner edge of the throttle element 30 configured as a resilient disk abuts in the region of the first opening 34, which offset dv1 leads to a pretension in the throttle element 30 configured as a resilient disk which must be exerted by a prevailing fluid pressure in order to lift the outer edge of the throttle element 30 configured as a resilient disk from the third support surface. As this happens the inner edge of the throttle element 30 configured as a resilient disk abuts both the first support surface arranged on the cylinder element 20 and the second support surface arranged in the cover 10, independently of the prevailing pressure.

Figure 2:
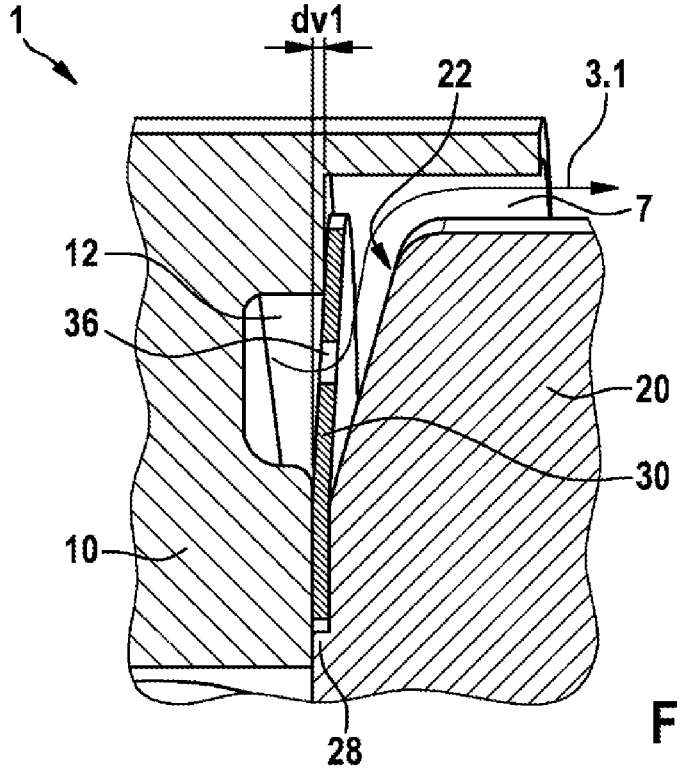
FIG. 2 shows a representation of a detail of the piston pump according to the disclosure from FIG. 1 in a first state.
Figure 3:
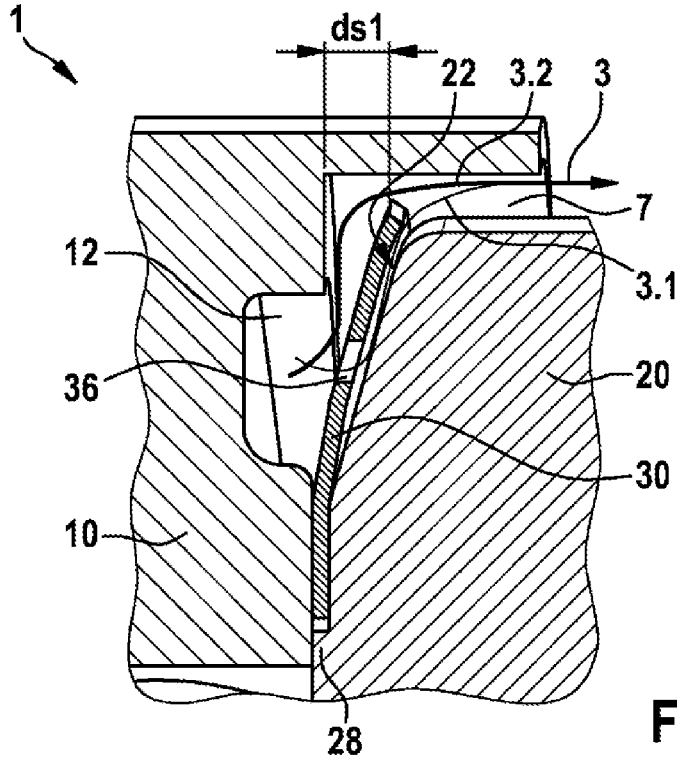
FIG. 3 shows a representation of a detail of the piston pump according to the disclosure from FIG. 1 in a second state.
Figure 4:
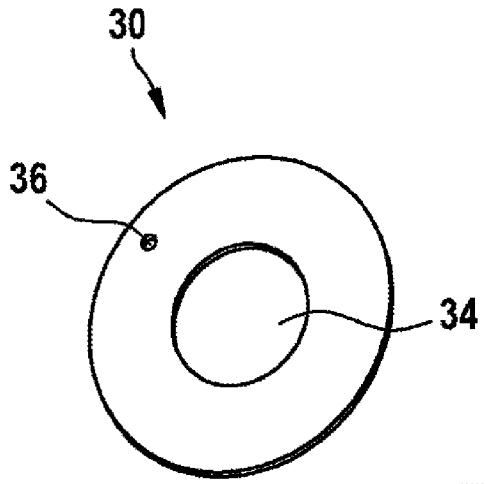
FIG. 4 shows a perspective representation of a throttle element for the piston pump from FIG. 1.
Figure 5:
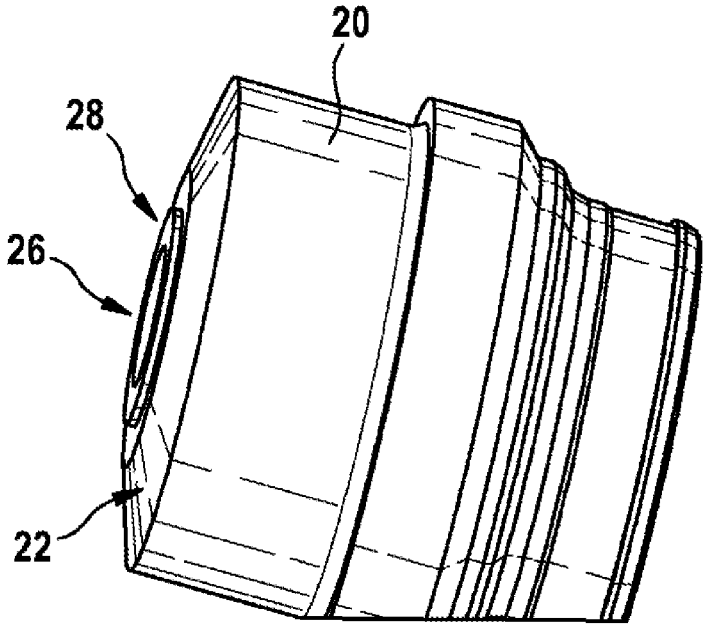
FIG. 5 shows a perspective representation of a cylinder for the piston pump from FIG. 1.
Figure 6:
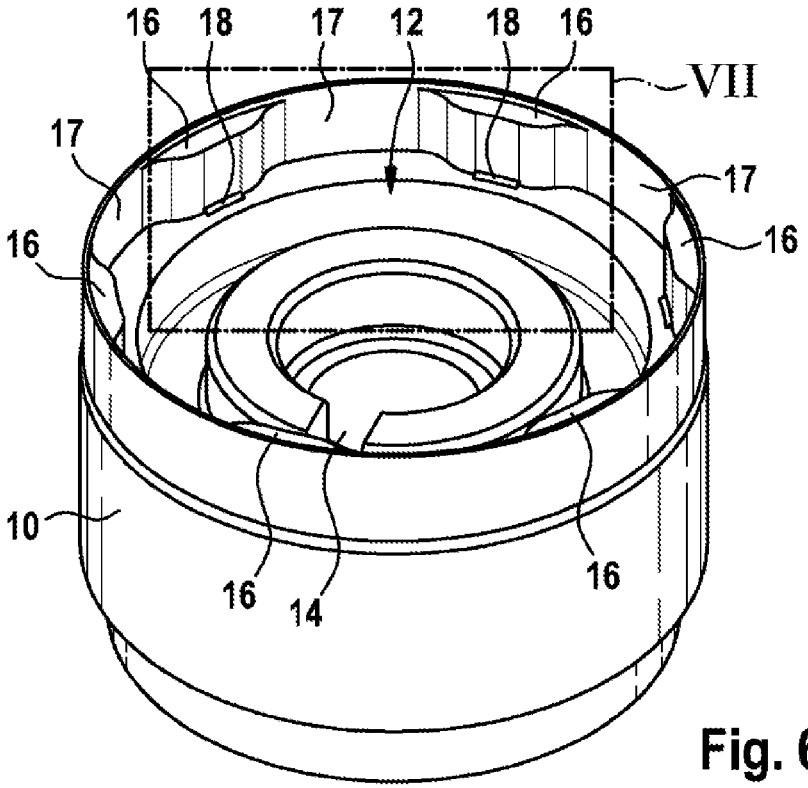
FIG. 6 shows a perspective representation of a cover for the piston pump from FIG. 1.
Figure 7:
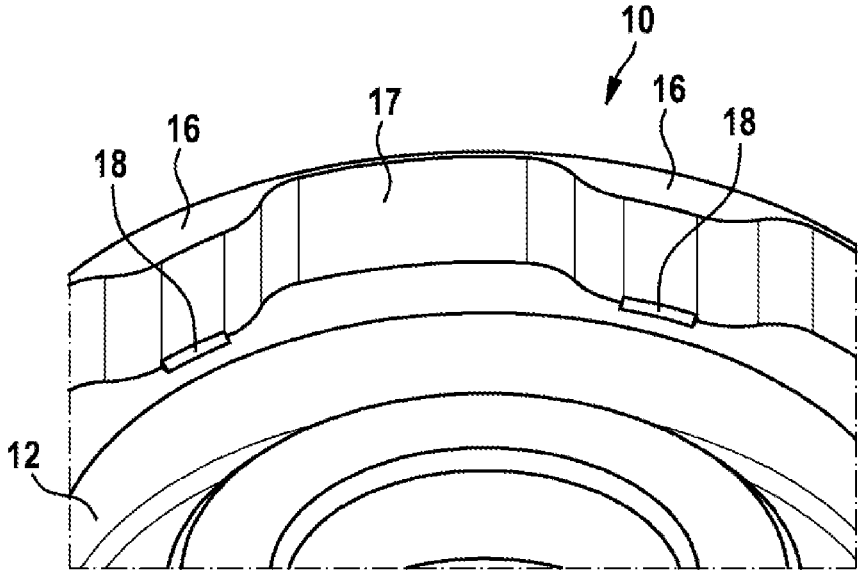
FIG. 7 shows a perspective representation of a detail of the cover for a piston pump from FIG. 6.
Figure 8:
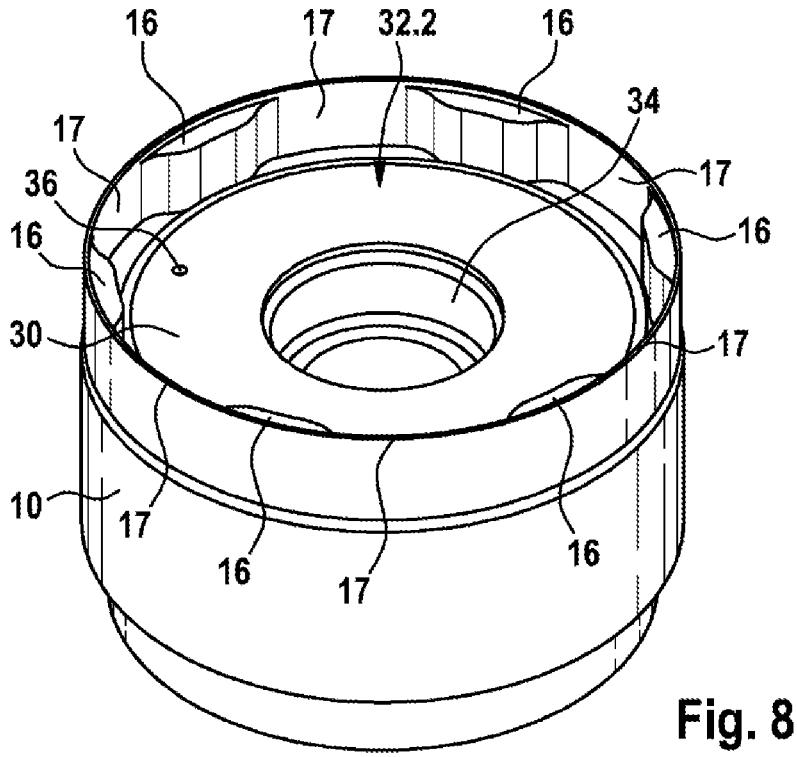
FIG. 8 shows a perspective representation of the cover from FIG. 6 or 7 with the throttle element from FIG. 4 inserted therein.
Figure 9:
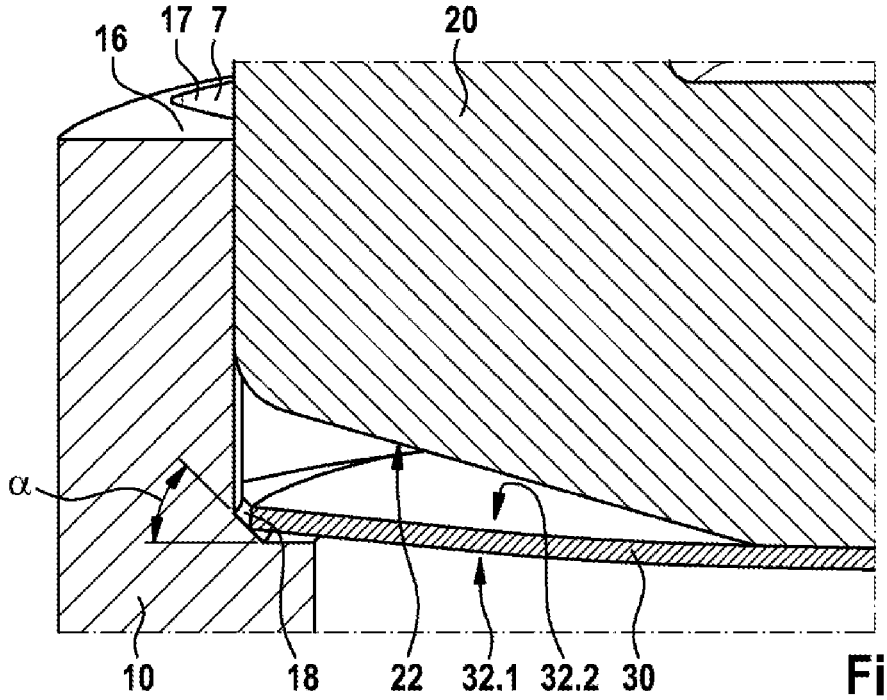
FIG. 9 shows a detailed perspective representation of a portion of the cover for a piston pump from FIGS. 6 to 8 with a cylinder pressed therein.

As is further apparent from FIGS. 1 to 5, a deformation movement ds1 of the throttle element 30 configured as a resilient disk is limited by a corresponding shaping of an end face 22 of the cylinder 20. In the exemplary embodiment represented, the end face 22 has a crowned configuration, the dimensions of the crown defining the maximum possible deformation movement of the throttle element 30 configured as a resilient disk. FIG. 2 shows the piston pump 1 under a differential pressure which is lower than a predefined pressure limit value, so that the throttle element configured as a resilient disk rests against all the support surfaces and only the static throttle is effective, so that an outflowing fluid flow 3.1 is determined by a second opening 36 formed as a bore in the throttle element 30 configured as a spring elastic disk. FIG. 3 shows the piston pump 1 under a differential pressure which is higher than the predefined pressure limit value, so that the outer edge of the throttle element 30 configured as a resilient disk is lifted from the third support surface and only the inner edge of the throttle element configured as a resilient disk abuts the first and second support surfaces. In this state the dynamic throttle is effective, so that a further fluid flow 3.2 passes around the throttle element configured as a resilient disk, which fluid flow 3.2 forms with the fluid flow 3.1 passing through the second opening 36 an outflowing total fluid flow 3. An annular channel 12 which is covered by the throttle element 30 is formed in the cover 10. With the outlet valve 5 open, that is, with the closing body 5.1 lifted from the outlet valve seat 5.2, the fluid enters the annular channel 58 via a connecting channel 14 and flows out via the throttle element 30 into at least one discharge channel 7.

As is further apparent from FIGS. 6 to 9, according to the disclosure centering means 18 which effect a pre-centering of the throttle element 30 in the cover 10 are present in the cover 10. In the exemplary embodiment illustrated, six pressing lugs 16, against which the cylinder 20 can be pressed together with the cover 10, are formed in the cover 10. Recesses 17, which act as discharge channels 7 for the fluid flow 3 with the cylinder 20 pressed in, are formed between each two pressing lugs 16. In the exemplary embodiment represented, the cover 10 of the piston pump 1 has six recesses 18 and the piston pump 1 therefore has six discharge channels 7.

As is further apparent from FIGS. 6 to 9, the centering means 18 include at least one chamfer which is arranged on each pressing lug 16 rearwardly in the pressing-in direction. In the exemplary embodiment represented the centering means 18 include six chamfers. As can be seen from FIG. 9, the individual chamfers 18 are each at an acute angle $\alpha$, which is preferably greater than 60°, in order to prevent jamming of the throttle element 30 configured as a resilient disk.

According to the process according to the disclosure for assembling a piston pump, the throttle element 30 is configured as a resilient disk and is inserted in the cover 10. As a result of the centering means 18 arranged in the cover 10, the throttle element 30 is pre-centered in the cover 10, and after the throttle element 30 has been inserted and pre-centered the cylinder element 20 can be pressed into the cover 10 without deforming or damaging the throttle element 30 configured as a resilient disk. Two centering means 28, which are configured as circumferential collars adapted to the first opening 34 in the throttle element 30, are provided at the outlet orifice 26 of the cylinder 20 and effect final centering of the throttle element 30.

Embodiments of the present disclosure advantageously make possible cost-neutral pre-centering of the throttle element in the cover of the piston pump.

The invention claimed is:

1. A piston pump for delivering fluids, comprising:

a cylinder;

a pressure chamber closed by a cover; and a throttle element disposed in a fluid flow downstream of an outlet valve, the throttle element being configured to throttle the fluid flow, wherein at least two pressing lugs are formed on the cover, wherein the cylinder is pressed against the at least two pressing lugs in a pressing-in direction, wherein at least one recess is formed between the at least two pressing lugs, the at least one recess acting as a discharge channel for the fluid flow, wherein the throttle element is configured as a resilient disk inserted in the cover, the cover including a centering mechanism configured to pre-center the throttle element, wherein the centering mechanism includes at least one chamfer arranged on each pressing lug of the at least two pressing lugs, the at least one chamfer arranged rearwardly in the pressing-in direction, and wherein the throttle element is deformable between a first configuration, wherein a portion of the throttle element contacts the cover, and a second configuration, wherein the portion of the throttle element does not contact the cover.

2. The piston pump as claimed in claim 1, wherein the at least one chamfer is at an acute angle.

3. The piston pump as claimed in claim 1, wherein:

an annular channel is formed in the cover, the annular channel is covered by the throttle element and filled with fluid when the outlet valve is open, and the fluid is configured to flow out via the throttle element into the discharge channel when the outlet valve is open and when the outlet valve is closed.

4. The piston pump as claimed in claim 3, wherein the throttle element is arranged between the cylinder and the cover and is configured to variably adjust a flow cross section in the discharge channel in dependence on a pressure difference between its upper side and underside.

5. The piston pump as claimed in claim 1, wherein a deformation movement of the throttle element is limited by an end face of the cylinder.

6. The piston pump as claimed in claim 1, wherein the throttle element has a first opening through which fluid is configured to flow, the fluid flowing through the first opening, around the throttle element when the throttle element is in a lifted position, or through the first opening and around the throttle element when the throttle element is in the lifted position.

7. The piston pump as claimed in claim 6, wherein the piston pump includes a second opening configured as one or more of a bore in the throttle element, a depression formed in support surfaces, and an annular gap, the second opening being open independently of a differential pressure and having a defined constant flow cross section.

8. A process for assembling a piston pump including a cylinder and a pressure chamber defined in part by an outlet valve and closed by a cover, the process comprising:

inserting a throttle element configured as a resilient disk in the cover such that the throttle element is deformable between a first configuration, wherein a portion of the throttle element contacts the cover, and a second configuration, wherein the portion of the throttle element does not contact the cover, the throttle element being disposed in a fluid flow downstream of the outlet valve and configured to throttle the fluid flow, the cover including a centering mechanism configured to effect a pre-centering of the throttle element in the cover; and pressing the cylinder into the cover after the throttle element has been inserted and pre-centered in the cover wherein at least two pressing lugs are formed on the cover, wherein the cylinder is pressed against the at least two pressing lugs in a pressing-in direction, wherein at least one recess is formed between the at least two pressing lugs, the at least one recess acting as a discharge channel for the fluid flow, and wherein the centering mechanism includes at least one chamfer arranged on each pressing lug of the at least two pressing lugs, the at least one chamfer arranged rearwardly in the pressing-in direction.

* * * * *